US005886953A

United States Patent [19]

Kawahara et al.

[11] Patent Number: 5,886,953

[45] Date of Patent: Mar. 23, 1999

[54] HEAVY-LOAD DRIVE APPARATUS FOR AN ELECTRONIC WATCH

[75] Inventors: Hisashi Kawahara, Tokyo; Shingo Ichikawa, Saitama, both of Japan

[73] Assignee: Citizen Watch Co., Ltd., Tokyo, Japan

[21] Appl. No.: 860,800

[22] PCT Filed: Nov. 7, 1996

[86] PCT No.: PCT/JP96/03262

§ 371 Date: Aug. 18, 1997

§ 102(e) Date: Aug. 18, 1997

[87] PCT Pub. No.: WO97/17636

PCT Pub. Date: May 15, 1997

[30] Foreign Application Priority Data

Nov. 7, 1995 [JP] Japan ..... 7-288248

[51] Int. Cl.[6] ..... G04B 9/00; G04B 1/00; G04C 3/00

[52] U.S. Cl. ..... 368/66; 368/204

[58] Field of Search ..... 368/66, 203–205

[56] References Cited

U.S. PATENT DOCUMENTS

| | | | |
|---|---|---|---|
| 4,395,138 | 7/1983 | Chihara | 368/204 |
| 4,634,953 | 1/1987 | Shoji et al. | 320/1 |
| 4,785,436 | 11/1988 | Sase | 568/205 |
| 4,879,669 | 11/1989 | Kihara et al. | 364/550 |
| 5,280,459 | 1/1994 | Nakamura | 368/80 |

FOREIGN PATENT DOCUMENTS

| | | |
|---|---|---|
| 54-87269 | 7/1979 | Japan . |
| 58-180976 | 10/1983 | Japan . |
| 63-186536 | 8/1988 | Japan . |

*Primary Examiner*—Vit Miska
*Attorney, Agent, or Firm*—Scully, Scott, Murphy & Presser

[57] ABSTRACT

A heavy-load driving device for a electronic watch is provided that assures reliable timekeeping operation and enables proper drive in accordance with the power supply voltage level. When drive command circuit generates an alarm-coincidence signal Sa, this signal Sa causes a preparatory judging circuit 10 to operate, so as to make a judgment, in accordance with the reduced power supply voltage level under a given load condition, as to whether or not to allow drive of a beeper device 31, a drive-enabling signal Svm being output if the judgment is to allow drive. By doing this, a heavy-load voltage detection circuit 21 starts to output a drive-time judgment signal Pvh which indicates the power supply voltage level judgment results. By means of the Svm signal, the a drive-signal control circuit 23 begins to operate, and at a drive condition selection circuit 25, in accordance with the signal Pvh, successive selection is made of a drive signal to be supplied to the beeper device 31 from the plurality of drive signals B75, B50, and B25 which are generated by the a drive-signal generating circuit 16, the selected drive signal driving the beeper device 31.

17 Claims, 9 Drawing Sheets

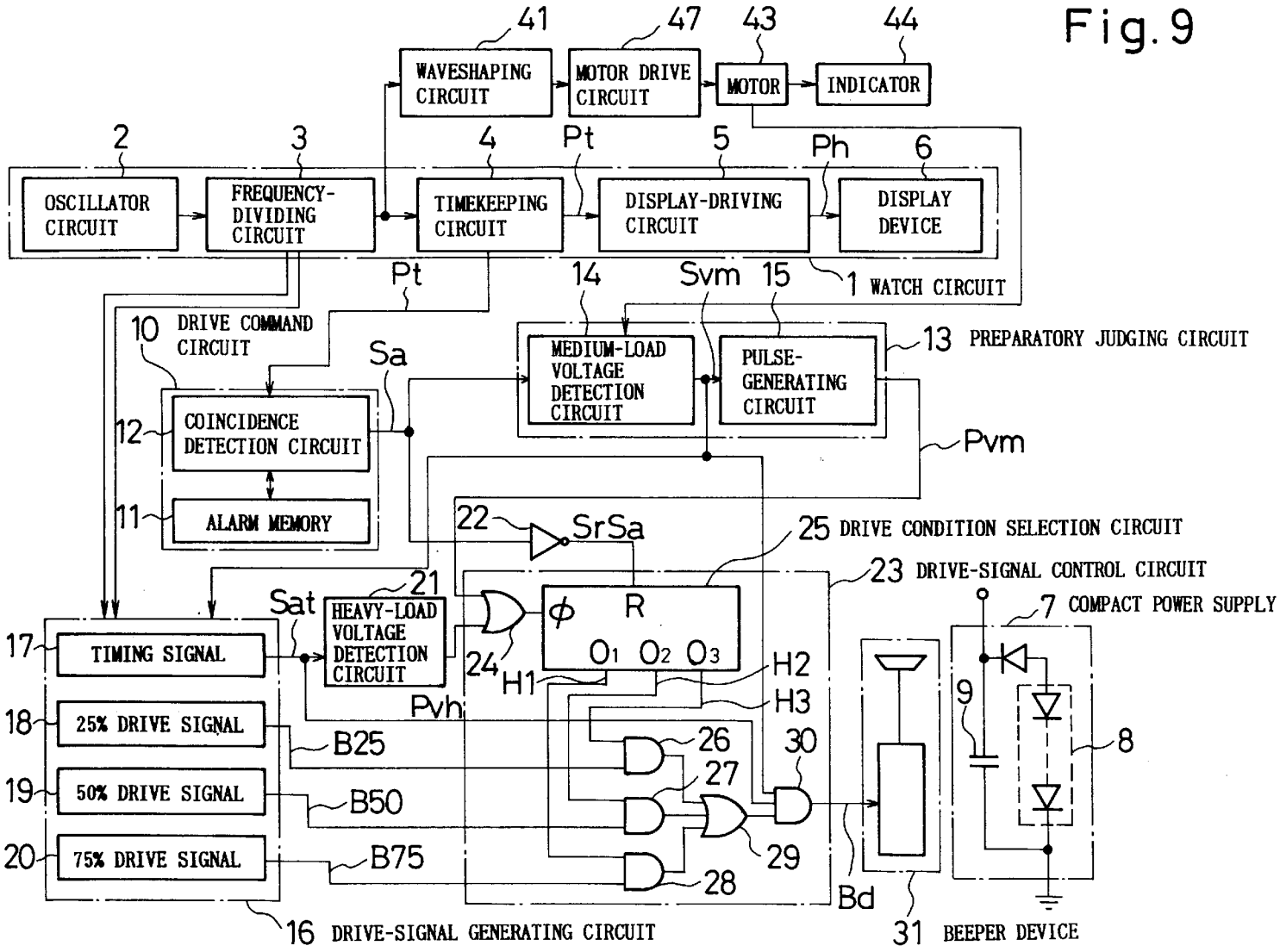
Fig. 9
OSCILLATOR CIRCUIT
FREQUENCY-DIVIDING CIRCUIT
WAVESHAPING CIRCUIT
MOTOR DRIVE CIRCUIT
MOTOR
INDICATOR
TIMEKEEPING CIRCUIT
DISPLAY-DRIVING CIRCUIT
DISPLAY DEVICE
1 WATCH CIRCUIT
DRIVE COMMAND CIRCUIT
13 PREPARATORY JUDGING CIRCUIT
PULSE-GENERATING CIRCUIT
MEDIUM-LOAD VOLTAGE DETECTION CIRCUIT
COINCIDENCE DETECTION CIRCUIT
ALARM MEMORY
25 DRIVE CONDITION SELECTION CIRCUIT
23 DRIVE-SIGNAL CONTROL CIRCUIT
HEAVY-LOAD VOLTAGE DETECTION CIRCUIT
7 COMPACT POWER SUPPLY
BEEPER DEVICE
DRIVE-SIGNAL GENERATING CIRCUIT
TIMING SIGNAL
25% DRIVE SIGNAL
50% DRIVE SIGNAL
75% DRIVE SIGNAL
Pt
Ph
Svm
Pvm
Sa
SrSa
Sat
Pvh
Bd
H1
H2
H3
B25
B50
B75

HEAVY-LOAD DRIVE APPARATUS FOR AN ELECTRONIC WATCH

TECHNICAL FIELD

The present invention relates to a heavy-load drive apparatus for an electronic watch which has a heavy-load means such as a beeper or illumination device and a compact power supply, in which the compact power supply is used as a drive power supply for driving the heavy-load means.

BACKGROUND ART

A heavy-load drive apparatus used for an electronic watch in the past, as already proposed by the applicant in Japanese Unexamined Patent Publication (KOKAI) No. 62-274289, has a battery voltage detection circuit which, in order to drive a beeper device which is the heavy-load means, detects the voltage level of a battery which serves as the drive power supply and outputs a drive-limiting signal continuously when this voltage level is below a prescribed value, and a drive level control circuit which, when the above-noted drive-limiting signal is input, controls the drive of the beeper device so that it is driven with a drive current that is smaller than when being driven normally, thereby enabling the operation of an alarm function without sacrificing the timekeeping function when the battery is worn, and also enabling the detection of battery deterioration in the electronic watch. There is also disclosure of a method for stopping the drive to the heavy-load means when the voltage level is below a prescribed value.

However, in the above-noted prior art, in the case of using a battery which does not exhibit a rapid change in voltage, but rather deteriorates slowly, such as is the case with silver or lithium batteries, it is not possible to achieve the intended effect.

With interest in recent years in achieving environmental friendliness, watches have come into common use in which a compact power supply using a solar battery system formed by the combination of a solar cell and a storage device is used as the drive power supply instead of using the conventional battery.

In the drive source for a solar battery system, the storage device has a small capacity compared to that of a conventional battery and can undergo a large change in voltage over a short period of time, caused by a change in the charging environment, there also arising the problem of a large difference between the no-load voltage and the heavy-load voltage.

Therefore, when applying the above-noted solar battery, the following problems arise.

(1) In a prior art heavy-load drive apparatus which must limit the drive of the heavy-load means when the power supply voltage is detected as being blow a prescribed value, regardless of how low the power supply voltage level drops, the limited drive is started, and with a drive source such as a solar battery, the voltage drop causes the power supply voltage to drop extremely low, so that often operation of the timekeeping function cannot be assured.

(2) In a heavy-load drive apparatus devised so that the heavy-load means is not driven when the power supply voltage level is below a prescribed value, in the case of a drive source exhibiting large voltage variations, such as a solar battery, the power supply voltage level drops below the prescribed value and often causes a stoppage of the drive to the heavy-load means, thereby causing the functional reliability to drop to an impractical level.

The above-noted problems will be described in more detail, with reference being made to FIG. 8.

FIG. 8 is a graph which shows an example of the time variations of the charging voltage in a solar battery.

In FIG. 8, the horizontal axis represents elapsed time, and the vertical axis represents the charging voltage of the solar battery, the various points indicated by squares being the measured values of power supply voltage level.

These measurements are performed at the time when performing normal drive of the heavy-load means, an so indicate the power supply voltage level when performing normal drive.

The solar battery illustrated in FIG. 8 exhibits a wide voltage variation from 1 V to 2 V. Consider the case in which the minimum voltage level Vmin at which timekeeping operation of the watch is guaranteed is 1 V, and a threshold value Vth is established at 1.15 V.

In the above-noted drawing, there is indicated a point P1 at which the power supply voltage level is 1 V.

When the power supply voltage level is below the threshold value, in the heavy-load drive apparatus which limits the drive of the heavy-load means, it continues to perform limited drive even at the point P1, so that ultimately when the power supply voltage level falls to below 1 V, it is no longer possible to assure proper operation of the watch.

In FIG. 8, although there is a plurality of points P2 which are below the threshold value but very close to 1.15 V, in a heavy-load drive apparatus devised so that the heavy-load means is not driven when the power supply voltage level is below the threshold value, at the above-noted points P2, the drive of the heavy-load means would stop.

The present invention was made to solve the above-noted problems in the prior art, and has as an object the provision of a heavy-load means for an electronic watch, which assures reliable operation of the watch and also performs proper drive in response to the power supply voltage level.

DISCLOSURE OF THE INVENTION

To achieve the above-noted object, the present invention has the technical constitution noted below. Specifically, for application of the present invention, an electronic watch which uses a compact power supply as a drive source and which is configured so as to drive a heavy-load means such as a beeper device or illumination device, has the above-noted drive source, the above-noted heavy-load means, a heavy-load driving means which drives the above-noted heavy-load means, a preparatory judging means which detects the electrical energy level of the above-noted drive source at the present time and which makes a judgment as to whether or not the drive source is capable of driving the heavy-load means, and a heavy-load means drive control signal outputting means which, in response to an output from the preparatory judging means, establishes whether or not to drive the above-noted heavy-load driving means.

More specifically, an electronic watch 100 according to the present invention, as shown in FIG. 1, has a timekeeping circuit 1, which is formed by an oscillator circuit 2, a frequency-dividing circuit 3, a display-driving circuit 5, and a display device 6, a power supply source 7, a heavy-load device 31, a heavy-load driving device 9, and a heavy-load drive-controlling means 4. In addition, it includes an external operating switch 10, for the purpose of causing drive of the heavy-load device 31. The heavy-load drive-controlling means 4 of the present invention controls the operation of the heavy-load driving device 9 that drives the heavy-load device 31.

The present invention has a judging means 8, which discriminates the current electrical energy condition of the power supply 7 being used, and which makes a judgment as to whether or not it is possible to drive the heavy-load device 31 at the current electrical energy condition of the power supply 7.

Therefore, the heavy-load driving control means 4, for example, in response to the judgment results of the power supply current energy amount judging means 8 of the power source 7, establishes whether or not to drive the heavy-load device 31. Additionally, in the present invention a control circuit 44 is provided to control the above-noted means, so that even if the above-noted energy amount judgment means 8 discriminates the energy amount of the power supply 7 and a drive signal for the heavy-load driving device 9 is output from the control circuit 44 so as to drive the heavy-load device 31, if the amount of energy of the power supply 7 is judged not to be sufficient to withstand driving the heavy-load device 31, the control circuit 44 controls the heavy-load drive-controlling means 4 so as to block that signal.

That is, the above-noted energy amount discriminating means 8 functions as a preparatory judging means which pre-judges the amount of energy of the power supply 7.

More specifically, the heavy-load drive-controlling means 4 of the present invention is configured so as to output a plurality of types of heavy-load means drive-controlling signals having different drive capacity as the drive signals to drive the heavy-load device 31, and the above-noted energy amount discriminating means 8, based on the results of the judgment of the amount of energy of the power supply 7, selects and outputs from the above-noted plurality of types of heavy-load means drive-controlling signals having different drive capacities one heavy-load means drive-controlling signal.

As another example of a different energy amount judging means 8 in the present invention, it is possible, as shown in FIG. 2, in the case in which the power supply 7 is formed by a solar battery 72, i.e., an electricity generating means, and a storage cell 71, that the judging means 8 consists of a generated electricity detection means 81 and the energy amount judgment means 8, further detects the amount of electricity generated by an electricity-generating means to thereby make a determination of the amount thereof stored in the electricity-storage means 71 and, if the detected value is above a given value, a heavy-load driving-controlling signal is output from the heavy-load drive-controlling means 4 to the heavy-load driving device 9.

As another example of a different energy amount judging means 8 in the present invention, it is possible to cause drive of either simply a resistance or a medium-load device such as a motor and to detect the voltage value when performing that drive, using the result to make a judgment of whether or not it is possible to drive the heavy-load driving device 9. In the present invention, a load such as a resistance or motor that is smaller than the load of, for example an alarm, but larger than the normal load for maintaining the operation of the electronic watch circuitry is defined as a medium load.

A specific example of an electronic watch according to the present invention will be described in detail below, with reference being made to the accompanying drawings.

In the configuration of the present invention, when a drive command circuit generates a drive command signal, this signal operates the preparatory judging circuit, which performs a judgment with regard to the reduction in the power supply voltage under given load conditions, so as to establish whether or not to allow drive of the above-noted heavy-load means, and output a drive enabling signal if drive is to be allowed. By means of this drive enabling signal, a drive signal control circuit operates, a drive signal that is generated by a drive signal generating circuit is supplied to the heavy-load means so as to drive it.

In the heavy-load driving device in an electronic watch according to the present invention, the above-noted drive signal generating circuit generates a plurality of types of drive signals having different drive capacities, the above-noted drive signal control circuit having a drive condition selection circuit, which selects from this plurality of drive signals, so that selective drive of the heavy-load means can be performed with different drive signals.

In the above-noted configuration, not only can the same effect as noted earlier be achieved, but additionally by operating a drive signal control circuit by means of a drive enabling signal from a drive command circuit, in the drive condition selection circuit a drive signal for the purpose of driving the heavy-load means is selected from a plurality of types of drive signals having different drive capacities generated by the drive signal generating circuit, so as to drive the heavy-load means with the selected drive signal.

By driving the heavy-load means by a plurality of drive signals having different drive capacities, it is possible to ensure reliable timekeeping operation and also to perform proper drive in accordance with the power supply voltage level.

In the heavy-load driving device of an electronic watch according to the present invention, a drive-time judgment circuit is provided, which makes a judgment as to the reduced level of power supply voltage when the heavy-load means is driven, a drive-time judgment signal output from this drive-time judgment circuit being used to control the above-noted drive condition selection circuit.

In the above-noted configuration, not only is the same effect as noted earlier achieved, but additionally the reduced level of power supply voltage when the heavy-load means is driven is judged by the drive-time judgment circuit, which outputs a drive-time judgment signal which indicates the results of this judgment, this drive-time judgment signal being used to control the drive condition selection circuit, thereby successively selecting the drive signal. By successively selecting the drive signal in response to the reduced power supply voltage level when driving the heavy-load means and driving the heavy-load means with the selected drive signal in this manner, it is possible to ensure reliable timekeeping operation and also to perform proper drive in accordance with the power supply voltage level.

In the heavy-load driving device of an electronic watch according to the present invention, the preparatory judging circuit is provided with a level-judging circuit which judges in stepwise manner the reduced power supply voltage, a plurality of level judgment signals output from this level-judging circuit controlling the above-noted drive condition selection circuit.

In the above-noted configuration, not only is the same effect as noted earlier achieve, but additionally, the level-judging circuit provided in the preparatory judging circuit makes a stepwise judgment of the reduced power supply voltage level when driving under a given load condition, and outputs a plurality of level judgment signals that indicate the judgment results, this plurality of level judgment signals controlling the drive condition selection circuit so as to pre-select the drive signal. By pre-selecting the drive signal in response to the reduced power supply voltage level under a given load condition and using the thus-selected drive signal to drive the heavy-load means, it is possible to ensure reliable timekeeping operation and also to perform proper drive in accordance with the power supply voltage level. Furthermore, a feature of an electronic watch according to the present invention is that the heavy-load driving device of the electronic watch is formed by a charging device such as a solar battery and a storage device which is charged by this charging device.

BRIEF DESCRIPTIONS OF THE DRAWINGS

FIG. 9 is a block diagram which shows the configuration of yet another embodiment of a heavy-load driving device in an electronic watch according to the present invention.

PREFERRED EMBODIMENTS

The preferred embodiments of the heavy-load driving device according to the present invention will be described in detail below.

Figure 3:
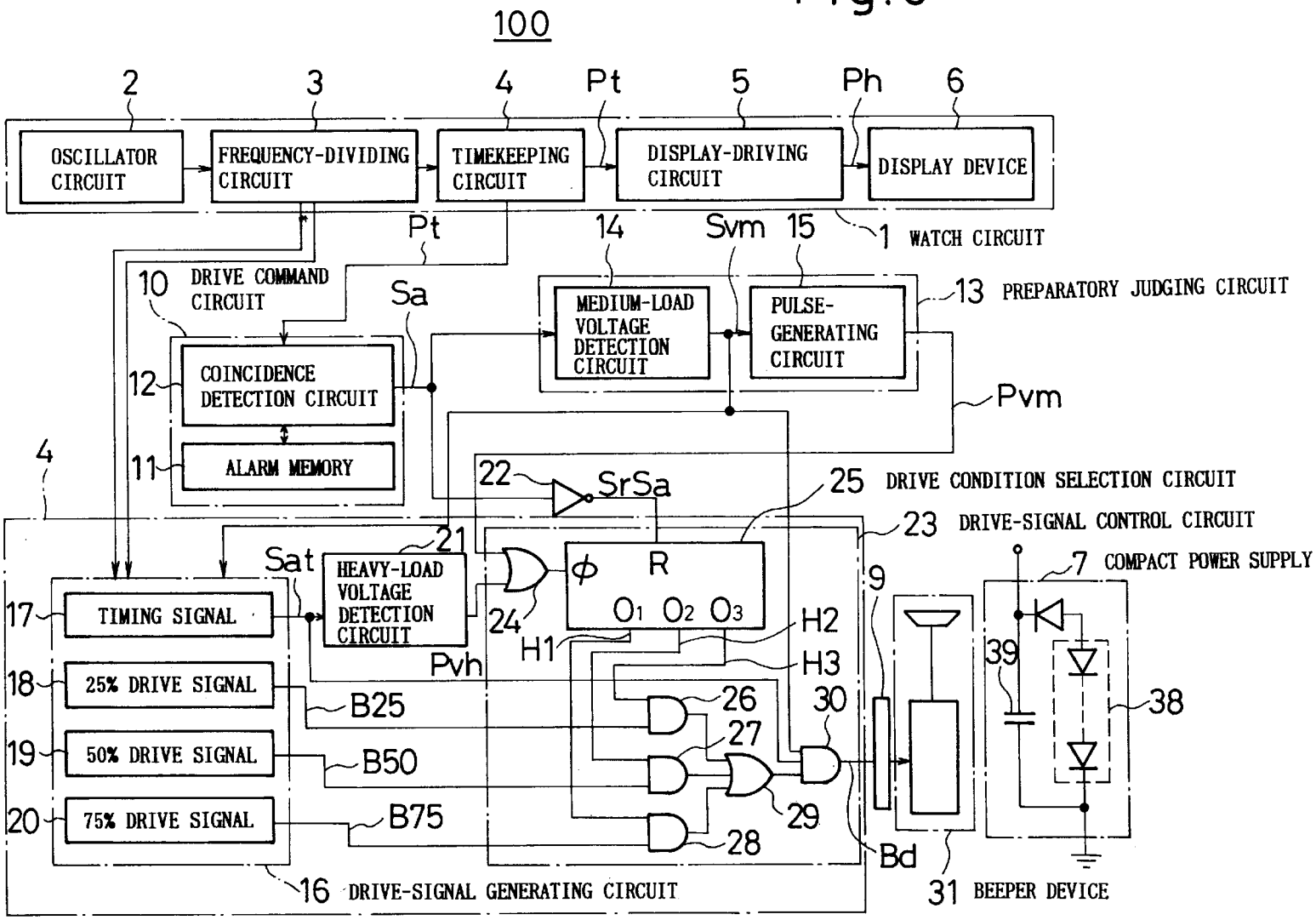
FIG. 3 is a circuit block diagram which shows the configuration of a different aspect of a heavy-load driving device according to the present invention.

FIG. 3 is a circuit block diagram which shows the configuration of the first embodiment of a heavy-load driving device according to the present invention, this having the same type of configuration as described earlier with regard to FIG. 1, this drawing in particular showing an electronic watch which uses a heavy-load driving device according to the present invention which was described in detail with regard to the heavy-load drive-controlling means 4.

In the electronic watch 100 according to the present invention which is shown in FIG. 3, the reference numeral 1 denotes a watch circuit, this watch circuit being formed by an oscillator circuit 2 which generates a clock signal, a frequency-dividing circuit 3 which frequency-divides the clock signal from this oscillator circuit 2 in a prescribed manner, a timekeeping circuit 4 which performs timekeeping by inputting the frequency-divided signal from the frequency-dividing circuit 3 and which outputs timekeeping information Pt that indicates the current time, a display-driving circuit 5 which outputs the timekeeping information Pt from the timekeeping circuit 4 as display information Ph, and a display device 6 which displays the current time according to the display information Ph which is output from the display-driving circuit 5.

Additionally, the reference numeral 7 denotes a compact power supply which serves as the drive source of the electronic watch, this being formed by a solar batter 38 and a capacitor 39 which is charged by the solar battery 38. The solar battery 38 corresponds to the charging device and the capacitor 39 corresponds to the storage device.

The reference numeral 10 denotes a drive command circuit, this being formed by an alarm memory 11 which stores an alarm generation time which is priorly set, and a coincidence detection circuit 12 which inputs the timekeeping information Pt from the timekeeping circuit 4 and which operates so as to output an alarm-coincidence signal Sa (at a high level "H") when the current time indicated by the timekeeping information Pt coincides with the alarm generation time that is stored in the alarm memory 11. This alarm-coincidence signal Sa corresponds to the drive command signal.

The numeral 13 denotes a preparatory judging circuit, which is formed by a medium-load voltage detection circuit 14 and a pulse-generating circuit 15.

When the alarm-coincidence signal Sa is input from the coincidence detection circuit 12 (that is, when the alarm coincidence is at the high level "H"), the medium-load voltage detection circuit 14 temporarily connects a load (hereinafter referred to as a medium load) which consumes a prescribed amount of current, for example 1 mA, to the power supply, and detects the power supply voltage level (the medium-load drive power supply voltage level) Vm at that time.

If the power supply voltage level Vm is greater than a prescribed value, for example, greater than 1.2 V, the medium-load voltage detection circuit 14 outputs a drive-enabling signal Svm (at a high level "H").

When the drive-enabling signal Svm is input from the medium-load voltage detection circuit 14, the pulse-generating circuit 15 outputs a drive-enabling pulse signal Pvm which is a single pulse.

The reference numeral 16 denotes a drive-signal generating circuit, this circuit having a timing-signal generating circuit 17, a 25% drive signal-generating circuit 18, a 50% drive signal-generating circuit 19, and a 75% drive signal-generating circuit 20, the output thereof being controlled in accordance to the drive-enabling signal Svm which is input from the medium-load voltage detection circuit 14.

That is, during the period in which the drive-enabling signal Svm is being input (at a high level "H"), a signal that is generated by these signal-generating circuits is output.

When timing-signal generating circuit 17 has the frequency-divided signal from the frequency-dividing circuit 3 as an input signal to it, and generates a timing signal Sat which is a pulse signal having a prescribed frequency.

The 25% drive signal-generating circuit 18, the 50% drive signal-generating circuit 19, and the 75% drive signal-generating circuit 20 have the frequency-divided signal as an input signal to them from the frequency-dividing circuit 3, and each output a 25% drive signal B25 which is a pulse signal having a duty cycle of 25%, a 50% drive signal B50 which is a pulse signal having a duty cycle of 50%, and a 75% drive signal B75 which is a pulse signal having a duty cycle of 75%, respectively.

The reference numeral 21 denotes a heavy-load voltage detection circuit, which is operating by inputting to it the timing signal Sat from the above-noted timing-signal generating circuit 17, and which detects the power supply voltage level Vh when in the condition of driving the beeper device.

If this power supply voltage level Vh is above a prescribed value, such as less than 1.15 V, this circuit outputs a drive-time judgment signal Pvh, which is a single-pulse signal.

The heavy-load voltage detection circuit 21 detects the reduction in the power supply voltage level when driving the beeper, that is, when under the heavy-load drive condition. This heavy-load voltage detection circuit 21 corresponds to the drive-time judgment circuit.

The reference numeral 23 denotes a drive-signal control circuit, this circuit being formed by an OR gate 24, a drive condition selection circuit 25, the AND gates 26, 27, and 28, the OR gate 29, and the AND gate 30.

The output of the AND gate 30 is input via the heavy-load driving means 9 to the heavy-load means 31, so as to drive the heavy-load means 31.

The OR gate 24 has a first input terminal and a second input terminal, the above-noted drive-enabling pulse signal Pvm being input to the first input terminal, and the above-noted drive-time judgment signal Pvh being input to the second input terminal.

The drive condition selection circuit 25 has a ϕ input terminal, a R reset input terminal, and 01, 02, and 03 output terminals. The ϕ input terminal thereof is connected to the output terminal of the OR gate 24, the alarm-coincidence signal Sa from the coincidence detection circuit 12 is input to the R reset terminal via an inverter 22 as an inverted alarm-coincidence signal SrSa, and the output terminals 01, 02, and 03 respectively output the gate control signal H1, the gate control signal H2, and the gate control signal H3.

The above-noted drive condition selection circuit 25 is reset when the R reset terminal changes from a low level "L" to a high level "H", driving all the output terminals 01, 02, and 03 to the low level "L", this reset condition being held during the period in which the reset terminal R is at the high level "H".

Next, when the reset terminal R changes from high level "H" to the low level "L", the reset condition is cleared, after that which when the ϕ input terminal changes from low level "L" to high level "H" (that is, when a pulse is input at the ϕ input terminal), only the 01 output terminal changes to the high level "H", the other output terminals remaining at the low level "L".

Next, when the second pulse is input at the ϕ input terminal, this time the output terminal 02 only changes to the high level "H", with the other output terminals are kept at the low level "L". Then, when a third pulse is input at the ϕ input terminal, only the 03 output terminal changes to the high level "H".

Next, when the fourth pulse or successive pulse is input at the ϕ input terminal, all output terminals 01, 02, and 03 are output at the low level "L", after that at each time when a pulse is input at theϕ input terminal the same operation is repeated, so that the output terminals 01, 02, and 03 are sequentially specified as high "H", respectively, or all output terminals being specified as low "L".

However, if a new reset is applied, all outputs are reset to the low level "L", regardless of their current condition.

The AND gates 26, 27, and 28 each have a first input terminal and a second input terminal. The above-noted gate control signal H3 is input to the first input terminal of the AND gate 26, and the above-noted 25% drive-signal B25 is input to the second input terminal thereof.

The above-noted gate control signal H2 is input to the first input terminal of the AND gate 27, and the above-noted 50% drive-signal B50 is input to the second input terminal thereof. The above-noted gate control signal H1 is input to the first input terminal of the AND gate 28, and the above-noted 75% drive-signal B75 is input to the second input terminal thereof.

The OR gate 29 has a first, a second, and a third input terminal, the first input terminal being connected to the output terminal of the AND gate 26, the second input terminal being connected to the output terminal of the AND gate 27, and the third input terminal being connected to the output terminal of the AND gate 28.

The AND gate 30 has a first, a second, and a third input terminal, the above-noted drive-enabling signal Svm being input to the first input terminal, the above-noted timing signal Sat being input to the second input terminal, and the third input terminal being connected to the output terminal of the OR gate 29.

The reference numeral 31 denotes a beeper device which, when a beeper drive signal Bd is input thereto, generates a beeping sound. This beeper device 31 corresponds to the heavy-load means.

Figure 1:
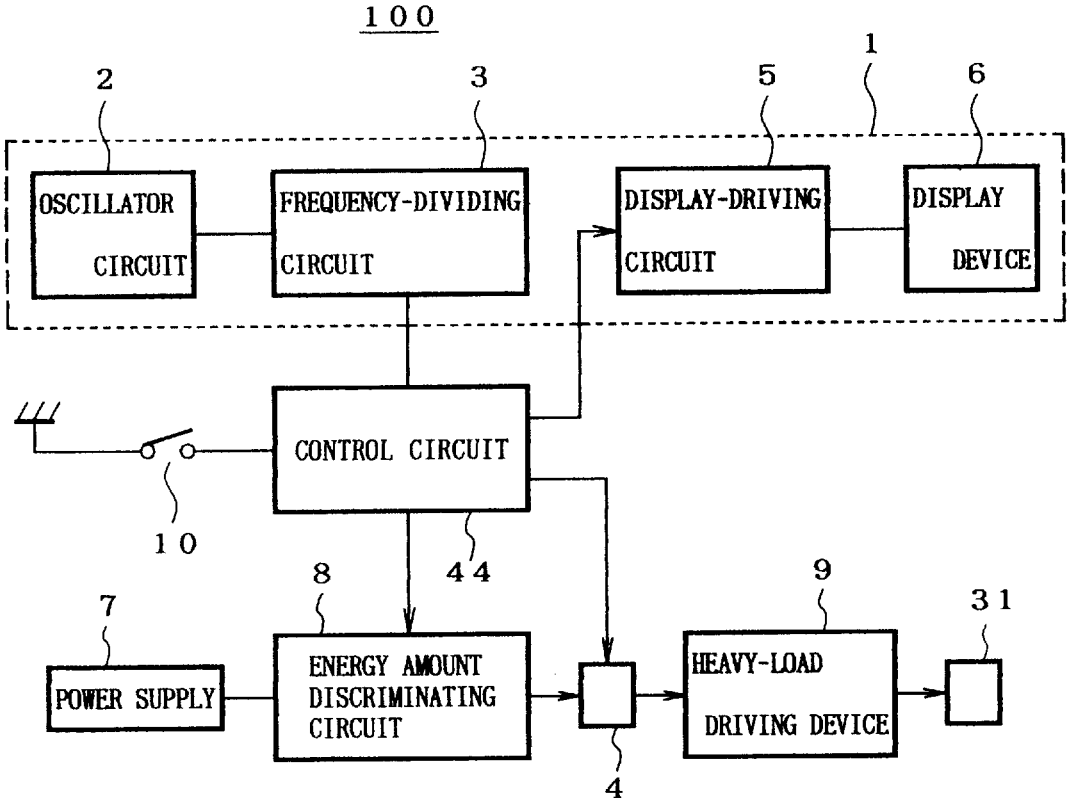
FIG. 1 is a block diagram which shows the configuration of an embodiment of a heavy-load driving device in an electronic watch according to the present invention.
Figure 2:
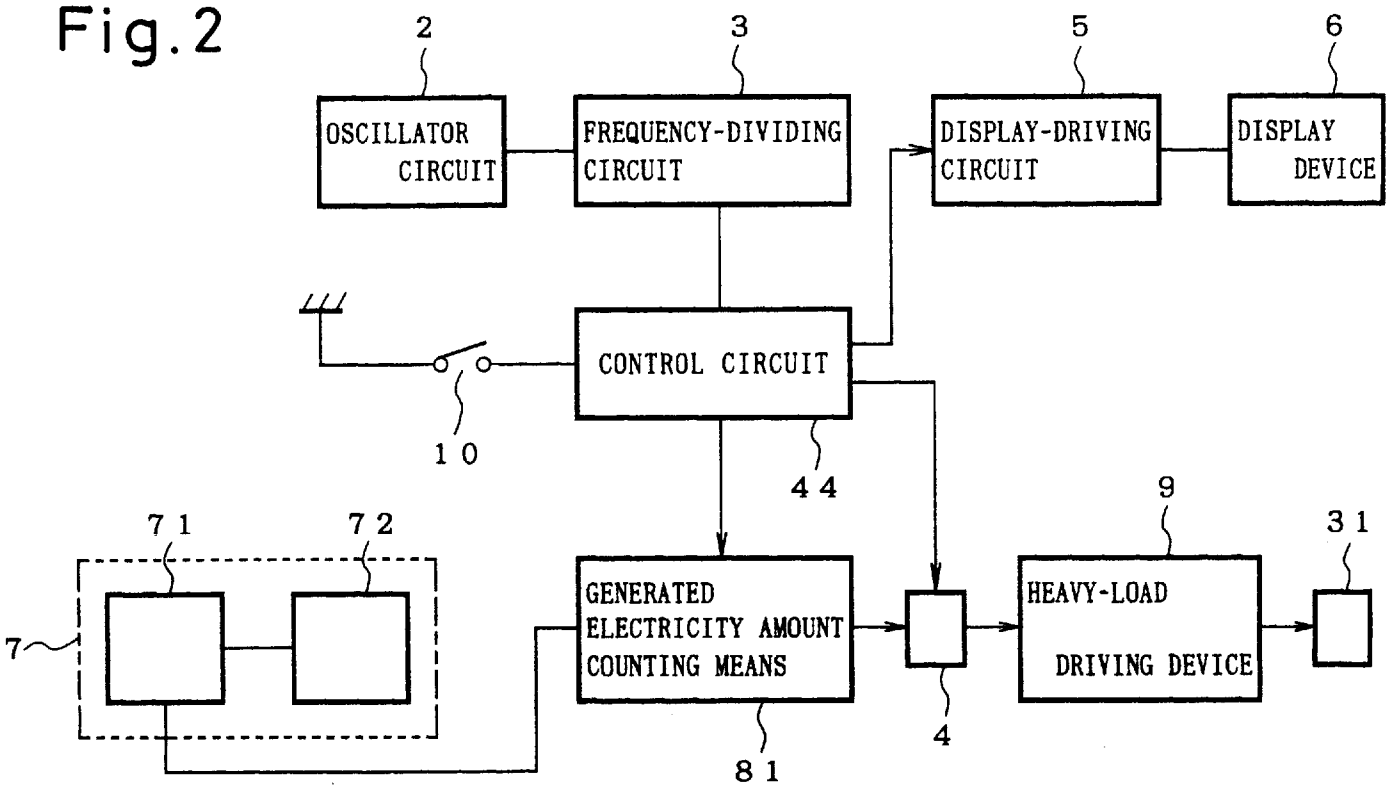
FIG. 2 is a block diagram which shows the configuration of a different embodiment of a heavy-load driving device in an electronic watch according to the present invention.

Of the configuration of the electronic watch 100 according to the present invention, as described above, the preparatory judging circuit 13 corresponds to the energy amount judging means 8 which is shown in FIG. 1, the drive command circuit 10 corresponds to the control circuit 44 which is shown in FIG. 1, and the heavy-load voltage detection circuit 21, drive-signal generating circuit 16, drive-signal control circuit 23, and drive condition selection circuit 25 correspond to the heavy-load drive-controlling means 4 which is shown in FIG. 1.

Therefore, in this embodiment a heavy-load drive-controlling means 4 is formed by above-noted circuits or means.

Next, the operation of the first embodiment of the according to the present invention, as described above, will be described in detail, with reference being made to FIG. 4 and FIG. 5.

Figure 4:
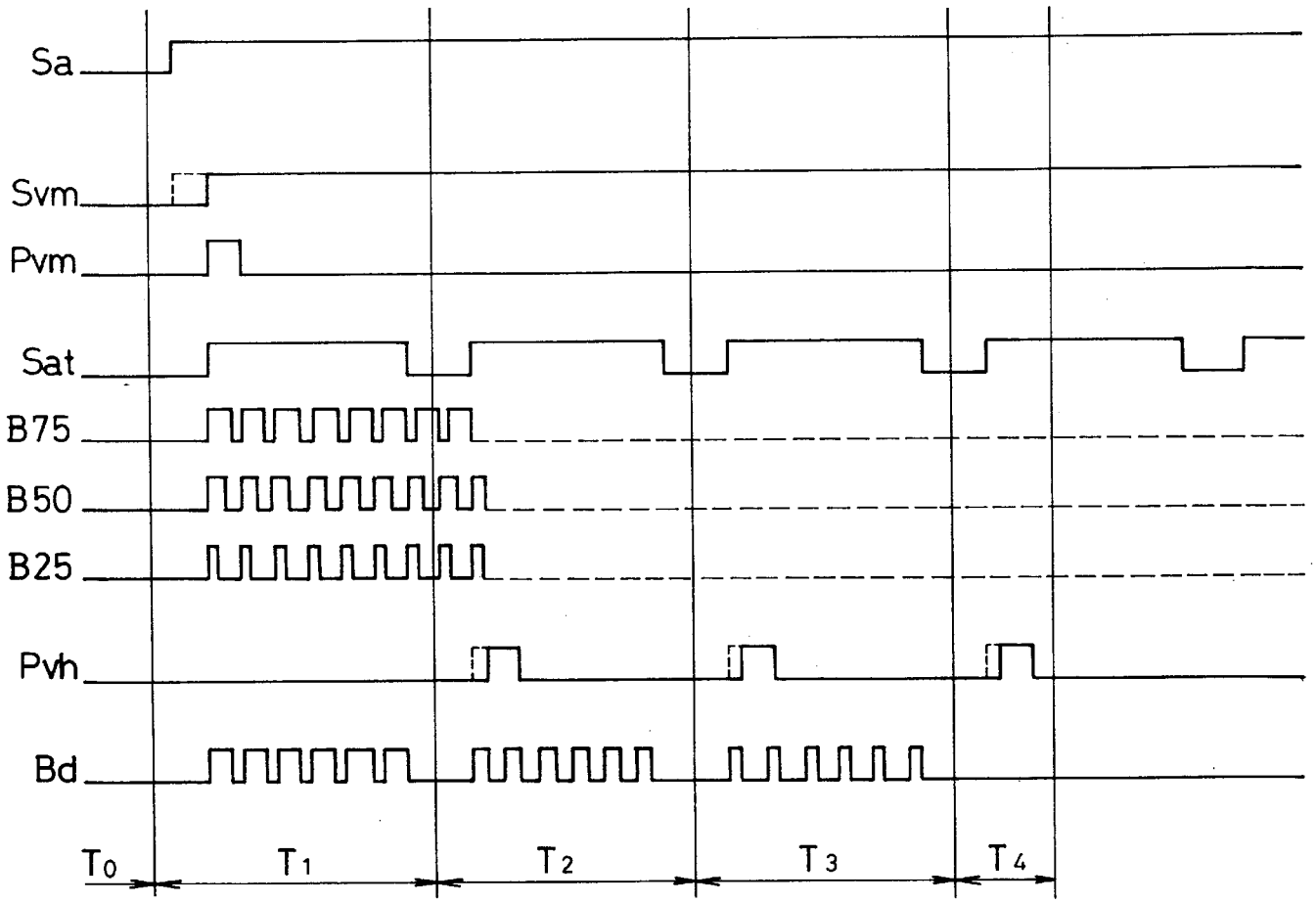
FIG. 4 is a timing diagram which shows the time waveforms of various signals in the aspect of the heavy-load driving device according to the present invention which is shown in FIG. 3.
Figure 5:
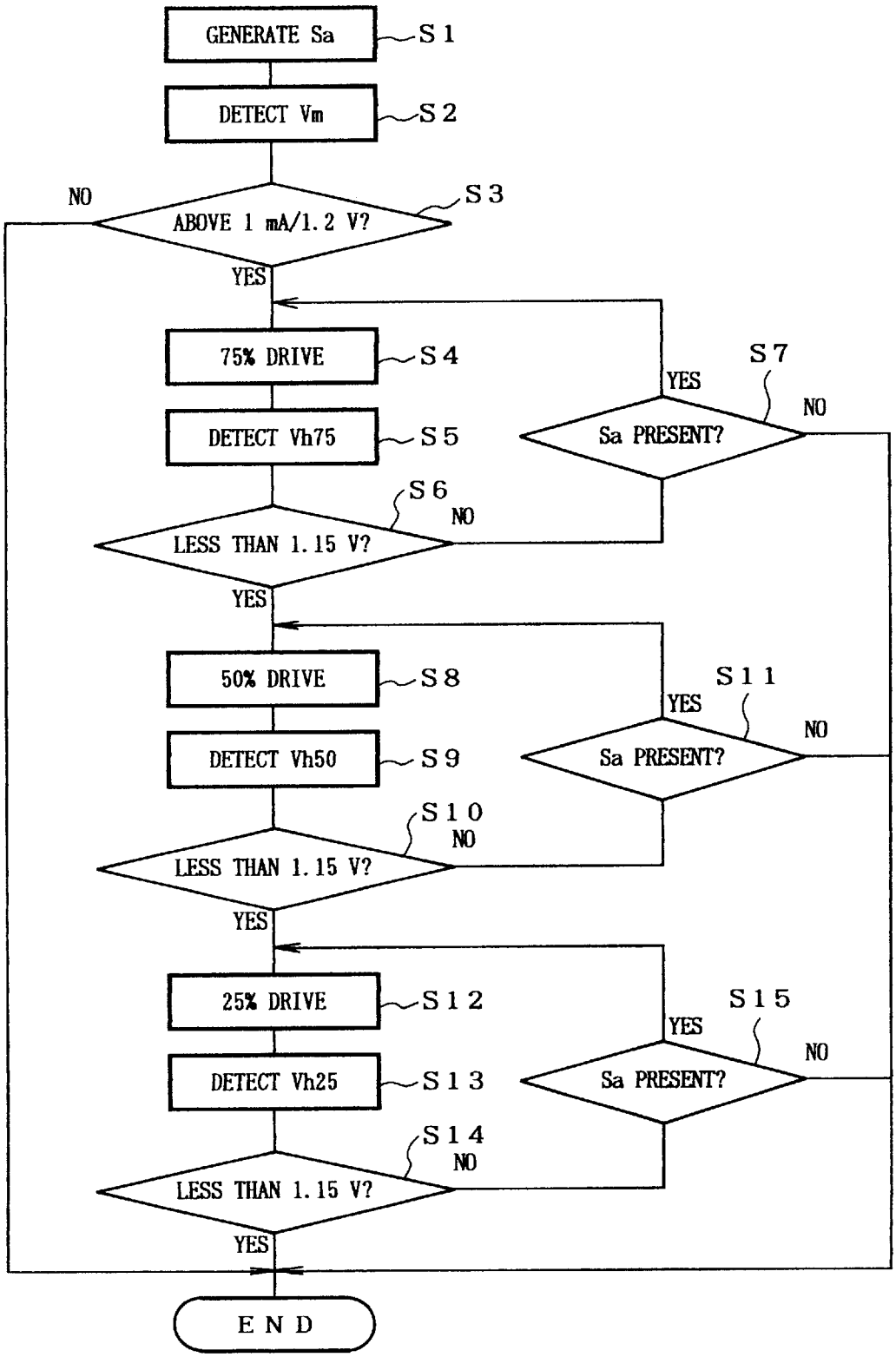
FIG. 5 is a flowchart which shows the drive sequence in driving a beeper device (heavy-load means) with the heavy-load driving device according to the present invention which is shown in FIG. 3.

FIG. 4 is a timing diagram which shows the time variations of various signals that are shown in FIG. 3, and FIG. 5 is a flowchart which shows the sequence of driving the beeper device 31.

First, in normal operation, the frequency-dividing circuit 2 receives the clock signal from the oscillator 1, and divides this signal, outputting a frequency-divided signal, this frequency-divided signal being input to the timekeeping circuit 3, which accordingly outputs the timekeeping information Pt, which is input to the display-driving circuit 5, which outputs the display information Ph, in accordance with which the display device 6 indicates the current time.

The timekeeping information Pt in accordance with the timekeeping circuit 3 is input to the coincidence detection circuit 12, which performs a comparison between the current time indicated by this timekeeping information Pt and the alarm generation time which has been stored in the alarm memory 1, and holds the alarm-coincidence signal Sa at the low level "L" if these two values do not coincide.

The time period T0 in FIG. 4 indicates the time waveforms of the various signals noted above.

Next, if the alarm generation time is reached, at step S1 shown in FIG. 5, the alarm coincidence detection circuit 12 detects the coincidence between the alarm generation time and the current time, and changes the alarm-coincidence signal Sa from the low level "L" to the high level "H".

This high-level "H" alarm-coincidence signal Sa is input, via the inverter 22, to the reset terminal R of the drive condition selection circuit 25, as the inverted alarm-coincidence signal SrSa having low level "L", thereby causing the reset condition of the drive condition selection circuit 25 to be released, so that operation starts according to the clock input at the ϕ input terminal thereof.

At step S2, when the alarm coincidence signal Sa changes to the high level "H", the medium-load voltage detection circuit 14 temporarily connects a medium load which consumes 1 mA of current to the power supply and detects the power supply voltage level Vm under this medium-load drive condition.

If the power supply voltage level Vm is lower than 1.2 V in step S3, drive is not performed of the beeper device 31 and this flow is ended. If, however, the power supply voltage level is 1.2 V or higher, the drive-enabling signal Svm is changed to the high level "H", and control proceeds to step S4.

At step S4, when the drive-enabling signal Svm changes to the high level "H", the drive-signal generating circuit 16 starts the output of the timing signal Sat, the 25% drive signal B25, the 50% drive signal B50, and the 75% drive signal B75.

The timing signal Sat from the timing-signal generating circuit 17 of the drive-signal generating circuit 16 is input to the heavy-load voltage detection circuit 21.

The heavy-load voltage detection circuit 21 detects the power supply voltage level Vh, and when this power supply voltage level Vh is less than 1.15 V, if the timing signal Sa changes from the low level "L" to the high level "H", although the drive-time judgment signal Pvh is output, because the beeper device 31 is not being driven at this time, the power supply voltage level for the non-heavy-load drive condition is detected.

Because of the output of the drive-enabling signal Svm from the medium-load voltage detection circuit 14, the non-heavy-load drive power supply voltage level is inevitably greater than 1.15 V, so that the drive-time judgment signal Pvh is not output.

When the drive-enabling signal Svm changes to the high level "H", the pulse-generating circuit 15 outputs the drive-enabling pulse signal Pvm, this drive-enabling pulse signal Pvm being input via the OR gate 24 as the first pulse to the f terminal of the drive condition selection circuit 25.

By doing this, the drive condition selection circuit 25 makes only the 01 output terminal high level "H", the other output terminals being kept low. That is, the gate control signal H1 is made high, and the gate control signals H2 and H3 are kept low.

The high-level gate control signal H1 is input to the first input terminal of the AND gate 28, thereby opening this gate, so that the 75% drive signal B75 from the 75% drive-signal generating circuit 20, which is input to the second input terminal thereof, is output from the gate.

The 75% drive signal B75 which is output from the AND gate 28 is input to the third input terminal of the AND gate 30 via the OR gate 29.

Because the high-level drive-enabling signal Svm from the medium-load voltage detection circuit 14 is input to the first input terminal of the AND gate 30, during the period in which the timing signal Sat from the timing-signal generating circuit 17, which is input to the second input terminal thereof, is high, the gate is opened, the 75% drive signal B75, which is input to the third terminal is output as the beeper drive signal Bd.

Therefore, the beeper device 31 is driven by the 75% drive signal B75 from the AND gate 30. The time period T1 in FIG. 4 shows the time waveforms of the various signals at steps S1 through S4, as shown in FIG. 5.

Returning to FIG. 5, at step S5, the heavy-load voltage detection circuit 21 detects the power supply voltage level Vh75 for heavy-load drive (in 75% driven condition) by the 75% drive signal B75, and at step S6 if this Vh 75 is 1.15 V or greater, control proceeds to step S7. If, however, the voltage is less than 1.15 V, control proceeds to step S8.

In the case in which the power supply voltage level Vh75 at step S6 is 1 15 V or greater, at step S7, if the drive-enabling signal Sa is at the high level "H", return is made to step S4, and 75% drive is maintained. If, however, the drive-enabling signal Sa was at the low level "L", the drive to the beeper device 31 is stopped, and this flow is ended.

If at step S6 the power supply voltage level Vh75 is less than 1.15 V, at step S8 when timing signal Sa changes from low level "L" to high level "H", the heavy-load voltage detection circuit 21 outputs the drive-time judgment signal Pvh, this drive-time judgment signal Pvh being input, via the OR gate 24, to the ϕ input terminal of the drive condition selection circuit 25 as the second pulse.

By doing this, the drive condition selection circuit 25 makes only the 02 output terminal high level "H", the other output terminals being made low level "L".

That is, the H2 gate control signal is made high level "H", and H1 and H3 gate control signals are made low level "L".

The high-level gate control signal H2 is input to the first input terminal of the AND gate 27, thereby opening the gate, so that the 50% drive signal B 50 which is input to the second input terminal thereof is output.

This 50% drive signal B50 is input to the third input terminal of the AND gate 30 via the OR gate 29, and during the period in which the timing signal Sat, which is input to the second input terminal of the AND gate 30 is high level H, the AND gate 30 is opened, the 50% drive signal B50 which is input to the third terminal is output as the beeper drive signal Bd. Therefore, the beeper device 31 is driven by the 50% drive signal B50 from the AND gate 30. The time period T2 in FIG. 4 shows the time waveforms of the various signals at step S8, as shown in FIG. 5.

Returning to FIG. 5, at step S9, the heavy-load voltage detection circuit 21 detects the power supply voltage level Vh50 for medium-load drive by the 50% drive signal, and at step S10 if this power supply voltage level Vh50 is 1.15 V or greater, control proceeds to step S11. If, however, the voltage is less than 1.15 V, control proceeds to step S12.

In the case in which the power supply voltage level Vh50 at step S10 is 1.15 V or greater, at step S11, if the drive-enabling signal Sa is at the high level "H", return is made to step S9, and 50% drive is maintained. If, however, the drive-enabling signal Sa was at the low level "L", the drive to the beeper device 31 is stopped, and this flow is ended.

If at step S10 the power supply voltage level Vh50 is less than 1.15 V, at step S12 when timing signal Sat changes from low level "L" to high level "H", the heavy-load voltage detection circuit 21 outputs the drive-time judgment signal Pvh, this drive-time judgment signal Pvh being input, via the OR gate 24, to the ϕ input terminal of the drive condition selection circuit 25 as the third pulse.

By doing this, the drive condition selection circuit 25 makes only the 03 output terminal high level "H", the other output terminals being made low level "L". That is, the H3 gate control signal is made high, and H1 and H2 gate control signals are made low level "L".

The high-level gate control signal H3 is input to the first input terminal of the AND gate 26, thereby opening the gate, so that the 25% drive signal B25 which is input to the second input terminal thereof is output.

This 25% drive signal B25 is input to the third input terminal of the AND gate 30 via the OR gate 29, and during the period in which the timing signal Sat, which is input to the second input terminal thereof, is high, the gate is opened, the 25% drive signal B25 which is input to the third terminal is output as the beeper drive signal Bd.

Therefore, the beeper device 31 is driven by the 25% drive signal B25 from the AND gate 30. The time period T3 in FIG. 4 shows the time waveforms of the various signals at step S12, as shown in FIG. 5.

Returning to FIG. 5, at step S13, the heavy-load voltage detection circuit 21 detects the power supply voltage level Vh25 for load drive by the 25% drive signal, and at step S14 if this power supply voltage level Vh25 is less than 1.15 V, when the timing signal Sat changes from low level "L" to high level "H", the drive-time judgment signal Pvh is output, from the heavy-load voltage detection circuit 21 this drive-time judgment signal Pvh being input to the ϕ input terminal of the drive condition selection circuit 25, via the OR gate 24, as the fourth pulse signal control.

By doing this, the drive condition selection circuit 25 makes all the 01 02, and 03 output terminal low level "L". That is all of the gate controlling signals H1 to H3 are set at low level "L". The result of this is that all the AND gates 26, 27, and 28 are closed, the output of the OR gate 29 being made low level "L".

Therefore, the drive to the beeper device 31 is stopped and this flow is ended. The time period T4 in FIG. 4 shows the time waveforms of the various signals at step S14, as shown in FIG. 5.

If at step S14, if the power supply voltage level Vh25 for 25% drive is 1.15 V or greater than 1.15V, control proceeds to step S15, at which time if the drive-enabling signal Sa is high, return is made to step S12 and 25% drive is maintained. If, however, the drive-enabling signal Sa was low level "L", the drive to the beeper device 31 is stopped, and this flow is ended.

According to the first embodiment of the present invention as described above, when the drive command circuit 10 generates an alarm-coincidence signal Sa, this alarm-coincidence signal Sa causes the preparatory judging circuit 13 to operate, and the medium-load voltage detection circuit 14 makes a judgment of the reduced power supply voltage level under a given load condition, thereby establishing whether or not the beeper device 31 is to be allowed to be driven, the drive-enabling signal Svm being output in the case in which drive is to be allowed.

By means of this drive-enabling signal Svm, the drive-signal generating circuit 16 begins to operate, the timing signal Sat thereof being output, resulting in the start of output of the drive-time judgment signal Pvh, which indicates the reduced level of power supply voltage Vh by the heavy-load voltage detection circuit 21.

By means of the drive-enabling signal Svm the drive-signal control circuit 23 begins to operate and at the drive condition selection circuit 25, in accordance with the drive-time judgment signal Pvh, a drive signal to be used to drive the beeper device 31 is successively selected from the drive signals B75, B50, and B25, which have differing drive capacities and which are generated by the drive-signal generating circuit 16, the beeper device 31 being driven by the thus-selected drive signal.

By successively switching the drive signal that is supplied to the beeper device 31 in accordance with the reduced power supply voltage level when driving, so that switched drive with different drive capacities is performed, both reliable operation of the watch is assured, and proper drive in response to the power supply voltage level is possible.

Figure 6:
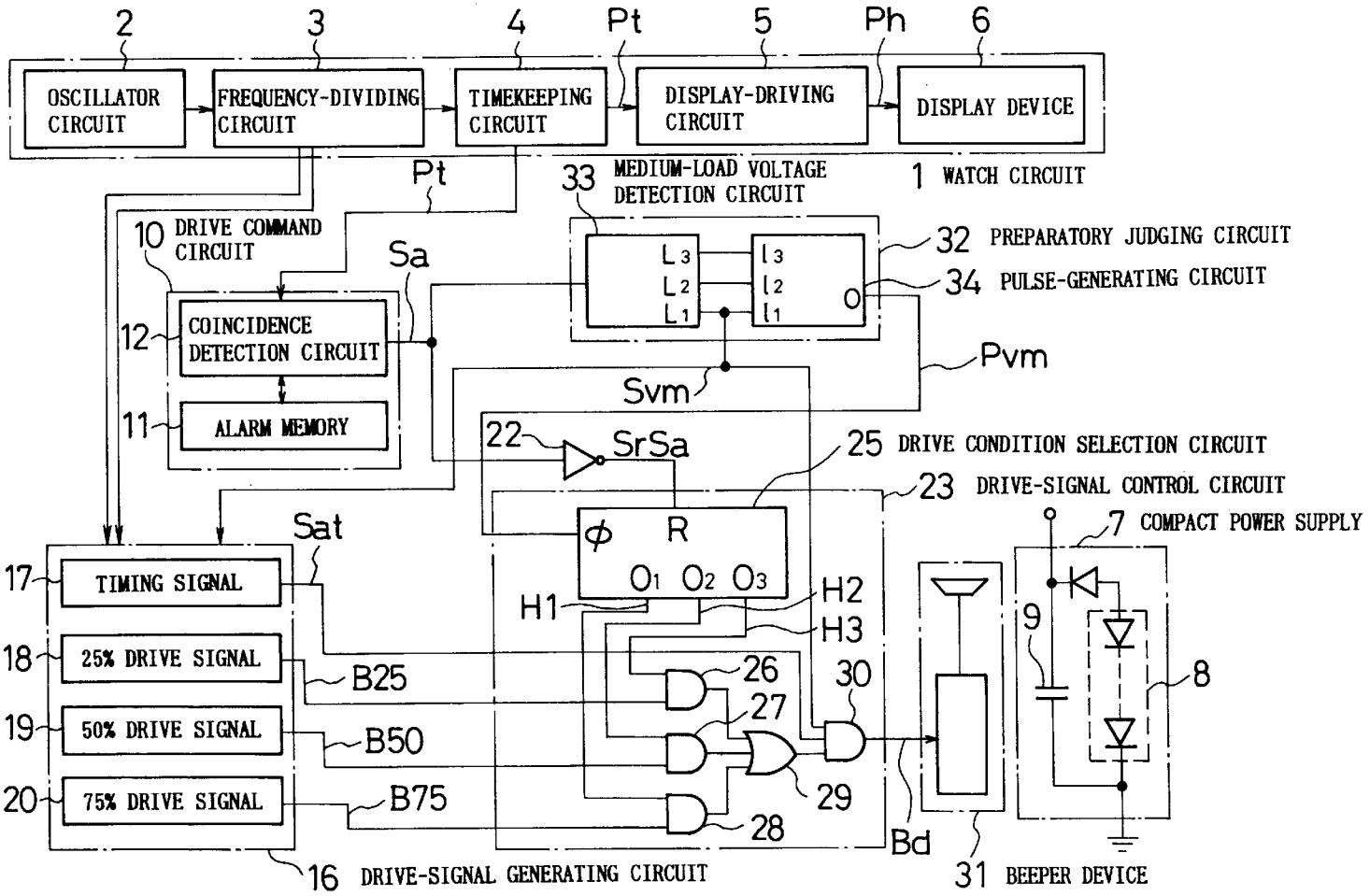
FIG. 6 is a circuit block diagram which shows the configuration of yet another aspect of the heavy-load driving device according to the present invention.

FIG. 6 is a block diagram which shows the configuration of the second embodiment of a heavy-load driving device according to the present invention, which shows an electronic watch which uses the heavy-load driving device of the present invention.

In FIG. 6, constitutional elements that are the same as ones in the first embodiment which is shown in FIG. 3 are assigned the same reference numerals, and will not be explicitly described herein.

In FIG. 6, the reference numeral 32 denotes a preparatory judging circuit, which is formed by a medium-load voltage detection circuit 33 and a pulse-generating circuit 34.

The medium-load voltage detection circuit 33 has an input terminal and the output terminals L1, L2, and L3, the alarm-coincidence signal Sa from the alarm coincidence detection circuit 12 being applied the above-noted input, each output terminal L1, L2, and L3 outputting a respective pulse control signal.

When the alarm-coincidence signal Sa from the alarm coincidence detection circuit 12 is not being input to it (that is, when the alarm-coincidence signal Sa is at the low level "L"), this medium-load voltage detection circuit 33 makes all of its output terminals L1, L2, and L3 low level "L". When the alarm-coincidence signal Sa is input (that is, when the alarm-coincidence signal Sa is at the high level "H"), a load (hereinafter referred to as the medium load) which consumes a prescribed current of, for example, 1 mA is temporarily connected to the power supply, and the power supply voltage level (the power supply voltage level under the medium-load condition) Vm at that time is detected, the output terminals L1, L2, and L3 being set to low or high level "H"s in accordance with the power supply voltage level Vm under the medium-load condition, as shown in Table 1.

TABLE 1

| Vm Detection | Low Level output | | | Pvm | Selection | Drive |
|---|---|---|---|---|---|---|
| Level | L1 | L2 | L3 | Output Pulse | Signal | Signal |
| Vm < 1.2 V | L | L | L | 0 | — | — |
| 1.2 < Vm < 1.25 | H | L | L | 3 | H3 | B25 |
| 1.25 < Vm < 1.3 | H | H | L | 2 | H2 | B50 |
| 1.3 < Vm | H | H | H | 1 | H1 | B75 |

The pulse control signal from the L1 output terminal is input to drive-signal generating circuit 16 and to the AND gate 30 as the drive-enabling signal Svm. This medium-load voltage detection circuit 33 corresponds to a level judgment circuit, and the pulse control signal corresponds to a level judgment signal.

The pulse-generating circuit 34 has the input terminals I1, I2, and I3, and an output terminal 0, a pulse control signal from the L1 output terminal of the medium-load voltage detection circuit 33 being input to the input terminal I1, the pulse control signal from the L2 output terminal being input to the input terminal I2, and the pulse control signal from the L3 output terminal being input to the input terminal I3.

The 0 output terminal is outputs the drive-enabling pulse signal Pvm, which has a prescribed number of pulses, in response to the pulse control signals from each of the output terminals L1, L2, and L3 of the medium-load voltage detection circuit 33 as shown in Table 1, this drive-enabling pulse signal Pvm being input to the 0 input terminal of the drive condition selection circuit 25.

Figure 7:
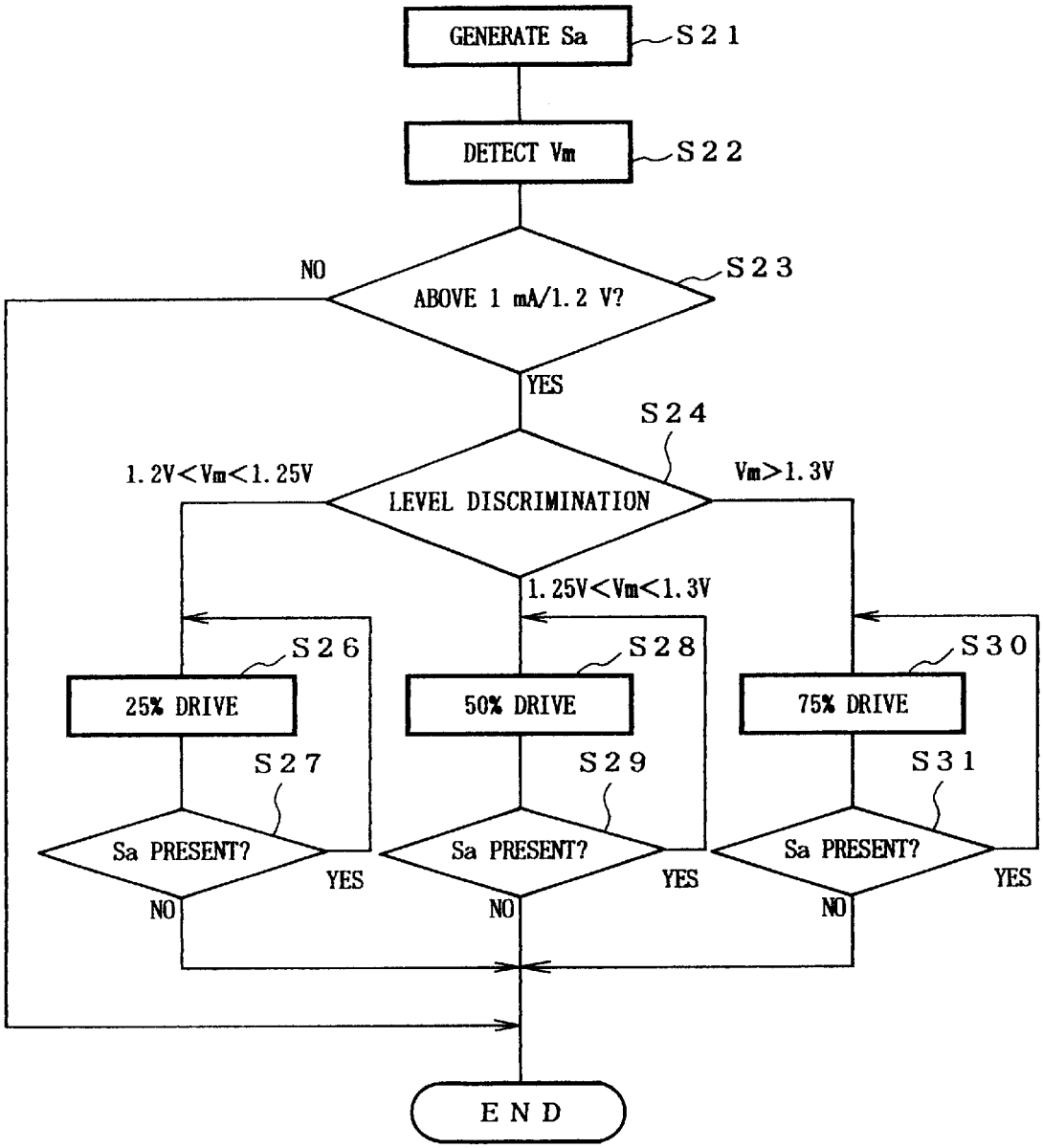
FIG. 7 is a flowchart which shows the drive sequence in driving a beeper device (heavy-load means) with the heavy-load driving device according to the present invention which is shown in FIG. 6.
Figure 8:
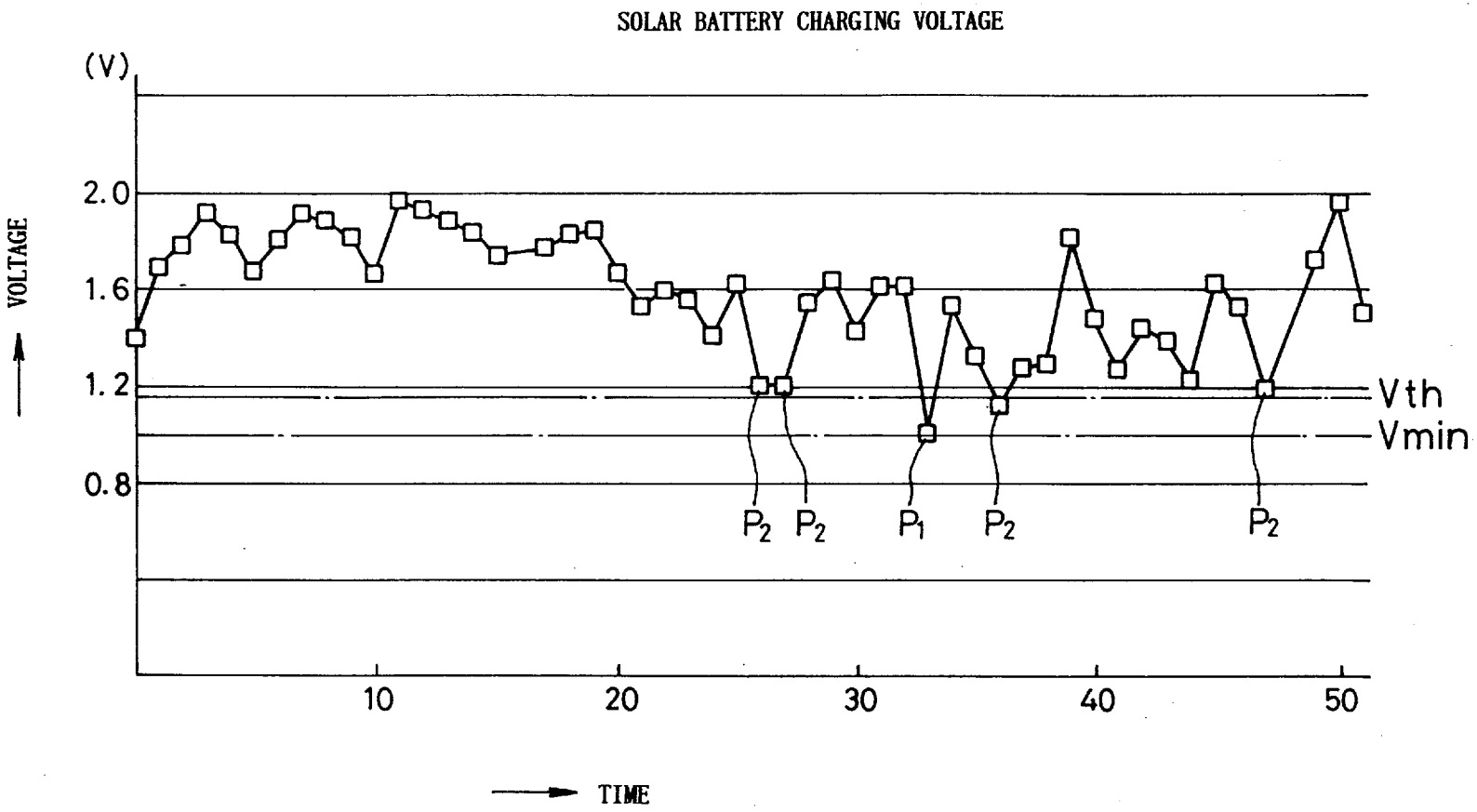
FIG. 8 is a graph which shows an example of the time variations of the charging voltage of a solar battery.

Next, the drive sequence for driving the beeper device 31 using the second embodiment of the present invention having the configuration as described above will be described, with reference being made to FIG. 7. FIG. 7 is a flowchart which shows the processing sequence for drive of the beeper device 31.

At step S21 in FIG. 7, when the alarm generation time is reached, the alarm-coincidence detection circuit 12 detects coincidence between the alarm generation time and the current time, and changes the alarm-coincidence signal Sa from low level "L" to high level "H".

This high-level alarm-coincidence signal Sa is input, via the inverter 22, as a low-level inverted alarm-coincidence signal SrSa to the reset terminal R of the drive condition selection circuit 25, which releases the reset condition thereof, thereby causing operation of the drive condition selection circuit 25 by means of the clock input applied at the ϕ input terminal.

At step S22, when the alarm-coincidence signal Sa becomes high level "H" the medium-load voltage detection circuit 33 temporarily connects a medium load which consumes a current of 1 mA to the power supply, and detects the power supply voltage level Vm under this medium-load condition, and at step S23 if this medium-load-drive power supply voltage level is lower than 1.2 V, the medium-load voltage detection circuit 33 sets all the output terminals L1 through L3 to the low level "L", as shown in Table 1.

The pulse control signals from these output terminals L1, L2, and L3 are applied to the input terminals I1, I2, and I3 of the pulse-generating circuit 34. Because all the input pulse control signals to the pulse-generating circuit 34 are low level "L1" as shown in Table 1, no drive-enabling pulse signal Pvm is output (that is, the number of output pulses is zero).

Therefore, all of the outputs 01, 02, and 03 of the drive condition selection circuit 25 are held at the low level "L". That is, all of the gate control signals H1 through H3 remain at the low level "L", so that none of the AND gates 26 through 28 is opened, the OR gate 29 therefore continuing to output a low level "L", so that the AND gate 30 does not open. Therefore, the beeper device 31 is not driven, and this flow is ended.

At step S23, if the medium-load-drive power supply voltage level is 1.2 V or higher, control proceeds to step S24, at which a judgment is made of the power supply voltage level Vm under medium load. That is, if the power supply voltage level is 1.2 V or greater, the flow proceeds to step S26, if the voltage is 1.25 to 1.3 V, flow proceeds to step S28, and if the voltage is greater than 1.3 V, flow proceeds to step S30.

If at step S24 the medium-load power supply voltage level Vm is 1.2 to 1 25 V, at step S26 the medium-load voltage detection circuit 33, as shown in Table 1, sets the L1 output terminal to the high level "H", and sets both L2 and L3 output terminals to the low level "L".

The pulse control signals from each of the output terminals L1, L2, and L3 are input to the I1, I2, and I3 input terminals, respectively, of the pulse-generating circuit 34, the pulse-generating circuit 34 outputting a drive-enabling pulse signal PVm having 3 pulses, as shown in Table 1, in accordance with the above-noted pulse control signals.

Because the drive-enabling signal Svm (the pulse control signal from the L1 output terminal) changes to high level "H", the drive-signal generating circuit 16 starts the output of the timing signal Sat, the 25% drive signal B25, the 50% drive signal B50, and the 75% drive signal B75.

The drive-enabling pulse signal Pvm from the pulse-generating circuit 34 is input to the ϕ input terminal of the drive condition selection circuit 25. At this point, because 3 pulses are input at the ϕ input terminal, the drive condition selection circuit 25 makes the 03 output terminal high level "H", and the other output terminals low level "L". That is, the H3 gate control signal is made high level "H", while the H1 and H2 gate control signals are made low level "L".

The high-level H3 gate control signal is input to the first input terminal of the AND gate 26, thereby opening the AND gate 26, so that the gate outputs the 25% drive signal B25 from the 25% drive-signal generating circuit 18, which is applied to the second input terminal thereof. The 25% drive signal B25 from the AND gate 26 is input, via the OR gate 29, to the third input terminal of the AND gate 30.

Because there is a high-level drive-enabling signal Svm from the medium-load voltage detection circuit 33 to the first input terminal of the AND gate 30, during the period in which the timing signal Sat from the timing-signal generating circuit 17, which is applied to the second input terminal, is high level "H", the gate 30 is opened, on the other hand, since AND gate 26, the output of which is input to a third input terminal of the gate 30, is opened, the 25% drive signal B25 is generated from the 25% drive-signal generating circuit 18.

The 25% drive signal B25 is applied to the third input of the AND gate 30 via the OR gate 29.

Since the drive enable signal Svm having high level "H", output from the medium-load-drive voltage detecting circuit 33, is input to the first terminal of the AND gate 30, during the time when the timing signal Sat output from the timing signal generating circuit 17, which is input to the second input terminal is high level "H", the gate 30 is opened so that the 25% drive signal B25 applied to the third input of the AND gate 30 is output from the AND gate 30 as the beeper device 31 drive signal Bd.

Thus, the beeper device 31 is driven by the 25% drive signal B25 output in this manner from the AND gate 30.

During the period in which the drive-enabling signal Sa is at a high level "H", the 25% drive condition is maintained, and at step S27, when this drive-enabling signal Sa changes to the low level "L", the drive to the beeper device 31 is stopped, and this flow is ended.

Next, if at step S24 the medium-load power supply voltage level Vm is 1.25 to 1.3 V, at step 28 the medium-load voltage detection circuit 33, as shown in Table 1, sets the L1 and L2 output terminals to the high level "H", and sets the L3 output terminals to the low level "L".

The pulse control signals from each of the output terminals L1, L2, and L3 are input to the I1, I2, and I3 input terminals, respectively, of the pulse-generating circuit 34, the pulse-generating circuit 34 outputting a drive-enabling pulse signal Pvm having 2 pulses, as shown in Table 1, in accordance with the above-noted pulse control signals.

Because the drive-enabling signal Svm (the pulse control signal from the L1 output terminal) changes to high level "H", the drive-signal generating circuit 16 starts the output of the timing signal Sat, the 25% drive signal B25, the 50% drive signal B50, and the 75% drive signal B75.

The drive-enabling pulse signal Pvm from the pulse-generating circuit 34 is input to the ϕ input terminal of the drive condition selection circuit 25. At this point, because 2 pulses are input at the ϕ input terminal, the drive condition selection circuit 25 makes the 02 output terminal high level "H", and the other output terminals low level "L". That is, the H2 gate control signal is made high level "H", while the H1 and H3 gate control signals are made low level "L".

The high-level H2 gate control signal is input to the first input terminal of the AND gate 27, thereby opening the AND gate 27, so that the gate outputs the 50% drive signal B50 from the 50% drive-signal generating circuit 19, which is applied to the second input terminal thereof. The 50% drive signal B50 from the AND gate 26 is input, via the OR gate 29, to the third input terminal of the AND gate 30.

Because there is a high-level drive-enabling signal Svm from the medium-load voltage detection circuit 33 to the first input terminal of the AND gate 30, during the period in which the timing signal Sat from the timing-signal generating circuit 17, which is applied to the second input terminal, is high level "H", the gate is opened, so that the 50% drive signal B50 which is applied to the third input of the AND gate 30 output is output from the AND gate 30 as the beeper device 31 drive signal Bd. Thus, the beeper device 31 is driven by the 50% drive signal B50 output in this manner from the AND gate 30.

During the period in which the drive-enabling signal Sa is at a high level "H", the 50% drive condition is maintained, and at step S29, when this drive-enabling signal Sa changes to the low level "L", the drive to the beeper device 31 is stopped, and this flow is ended.

Finally, if at step S24 the medium-load power supply voltage level Vm is greater than 1.3 V, at step 30 the medium-load voltage detection circuit 33, as shown in Table 1, sets all the output terminals L1 through L3 to the high level The pulse control signals from each of the output terminals L1, L2, and L3 are input to the I1, I2, and I3 input terminals, respectively, of the pulse-generating circuit 34, the pulse-generating circuit 34 outputting a drive-enabling pulse signal Pvm having 1 pulse, as shown in Table 1, in accordance with the above-noted pulse control signals.

Because the drive-enabling signal Svm (the pulse control signal from the L1 output terminal) changes to high level "H", the drive-signal generating circuit 16 starts the output of the timing signal Sat, the 25% drive signal B25, the 50% drive signal B50, and the 75% drive signal B75.

The drive-enabling pulse signal Pvm from the pulse-generating circuit 34 is input to the ϕ input terminal of the drive condition selection circuit 25. At this point, because 1 pulse is input at the ϕ input terminal, the drive condition selection circuit 25 makes only the 01 output terminal high level "H", and the other output terminals low level "L". That is, the H1 gate control signal is made high level "H", while the H2 and H3 gate control signals are made low level "L".

The high-level H1 gate control signal is input to the first input terminal of the AND gate 28, thereby opening the AND gate 28, so that the gate outputs the 75% drive signal B75 from the 75% drive-signal generating circuit 20, which is applied to the second input terminal thereof. The 75% drive signal B75 from the AND gate 28 is input, via the OR gate 29, to the third input terminal of the AND gate 30.

Because there is a high-level drive-enabling signal Svm from the medium-load voltage detection circuit 33 to the first input terminal of the AND gate 30, during the period in which the timing signal Sat from the timing-signal generating circuit 17, which is applied to the second input terminal, is high level "H", the gate is opened, so that the 75% drive signal B75 which is applied to the third input of the AND gate 30 is output from the AND gate 30 as the beeper device 31 drive signal Bd. Thus, the beeper device 31 is driven by the 75% drive signal B75 output in this manner from the AND gate 30.

During the period in which the drive-enabling signal Sa is at a high level "H", the 75% drive condition is maintained, and at step S31, when this drive-enabling signal Sa changes to the low level "L", the drive to the beeper device 31 is stopped, and this flow is ended.

In the second embodiment of the present invention as described above, when the drive command circuit 10 generates the alarm-coincidence signal Sa, this alarm-coincidence signal Sa operates the preparatory judging circuit 32, and at the medium-load voltage detection circuit 33, a judgment of the reduced power supply voltage level under a given load condition is made in four steps, thereby making a judgment of whether or not to permit drive of the beeper device 31.

In the case in which drive is to be allowed, the drive-enabling signal Svm is output, a plurality of pulse control signals which indicate the results of the judgment being input to the pulse-generating circuit 34, this pulse-generating circuit 34 outputting drive-enabling pulse signals Pvm, the pulse number of which is different from each other, in accordance with the plurality of pulse control signals.

By means of the above-noted drive-enabling signal Svm, the operation of the drive-signal control circuit 23 is started, the drive condition selection circuit 25 pre-selecting a drive signal to be supplied to the beeper device 31, in accordance with the above-noted drive-enabling pulse signal Pvm, from the plurality of drive signals B25, B50, and B75 having different drive capacities generated by the drive signal generating circuit 16, and driving the beeper device 31 by means of the thus-selected drive signal.

By pre-selecting the drive signal capacity in response to the reduced power supply voltage level under a given load condition in the manner and performing drive with the selected drive capacity, reliable timekeeping is ensured and also proper drive is possible in accordance with the power supply voltage level.

Next, turning to FIG. 9, a method for discriminating the electrical energy of the power supply 7 by detecting the current flowing in a motor or a voltage related thereto, will be explained in that current or voltage detecting means is used as the preparatory judging circuit 13 in an electronic watch 100 according to the present invention.

Specifically, as can be clearly seen from the circuit diagram shown in FIG. 9, in that a motor drive pulse is extracted from the output of the frequency-dividing circuit 3 via a waveshaping circuit 41, this is supplied to a motor drive circuit 47 to cause the motor 43 to rotate, so as to drive a hand 44, the drive voltage or drive current generated from the motor is detected, and the result of this detection being input to the medium-load voltage detection circuit 14, and a method similar to that described above being used to discriminate the electrical energy of the power supply 7.

As described above, the configuration of the electronic watch 100 according to the present invention has a heavy-load driving means for driving a heavy-load means, a heavy load driving control means which controls to drive the above-noted heavy-load means, a preparatory judging means which detects the electrical energy level of the above-noted drive source at the present time and which makes a judgment as to whether or not the drive source is capable of driving the heavy-load means, and a heavy-load means drive control means which, in response to an output from the preparatory judging means, establishes whether or not to drive the above-noted heavy-load driving means.

Additionally, the above-noted preparatory judging means has a comparing means which makes a comparison judgment between the current electrical energy level of the drive source and a pre-established reference level.

The comparing means of the present invention can also compare the electric energy level held by the drive source with a plurality of reference levels, and output different comparison judgment signals corresponding to the respective reference levels.

The above-noted electrical energy level in the electronic watch according to the present invention can be either the voltage value or the current value of the drive source when the drive source is connected to an appropriate medium load, and the medium-load driving means can be formed by either a resistance or a motor.

In addition, the power supply used in the electronic watch 100 according to the present invention can be formed by an electric power source including an electricity generating means such as a solar battery or a storage device which is charged by this charging device, and can also be a secondary cell such as a lithium ion secondary cell.

In the case in which the power supply used in an electronic watch 100 according to the present invention is an electrical generating type of power supply, it is desirable that the electrical energy to be detected be the generated electricity detected value of the drive source.

In an electronic watch 100 according to the present invention, the heavy-load means drive control means can include a drive-signal generating means which outputs a plurality of heavy-load drive control signals having different drive capacities and a drive condition selection means which is configured so as to select one of the plurality of heavy-load drive control signals in response to a comparison judgment signal output from the above-noted comparison judging means, and the it is desirable that the plurality of types of heavy-load drive control signals having different drive capacities, may comprise driving signals each of which having mutually differing duty cycle values.

The preparatory judging means which is used in the electronic watch 100 according to the present invention is configured so as to execute judgment processing in response to a heavy-load drive command signal which is output from the drive command means, and to output the results thereof to the heavy-load drive control means, and the drive-signal generating means is configured so as to generate a plurality of drive signals having different drive capacities.

The drive-signal generating means which is used in the electronic watch 100 according to the present invention is configured so as to output an appropriate timing signal in response to the output signal from the preparatory judging means, and it is desirable that the heavy-load driving control means include a drive condition selection means for the purpose of selecting one of the plurality of drive signals of different drive capacities which are generated by the drive-signal generating means.

As described in detail above, according to the heavy-load driving device for an electronic watch according to the present invention, in an electronic watch having a compact power supply such as a solar battery as a drive source and which drives a heavy-load means such as a beeper device or illumination device, a drive command circuit which generates a drive command signal, a drive-signal generating circuit which generates a drive signal for the purpose of driving the heavy-load means, a drive-signal control circuit which controls the supply of the drive signal, and a preparatory judging circuit which judges the reduced power supply voltage level under a given load condition and outputs a drive-enabling signal are provided, the above-noted preparatory judging circuit making a judgment, in accordance with the above-noted drive-enabling signal, of the reduced power supply voltage level under a given load condition, thereby establishing whether or not to allow drive of the heavy-load means, so that the drive-enabling signal is output after verifying that driving the heavy-load means will not result in sacrificing the timekeeping function, thereby enabling provision of an electronic watch in which the stability of the drive source is ensured.

By providing a drive-signal generating circuit which generates a plurality of drive signals having different drive capacities, a drive condition selection circuit, and a drive-time judging circuit which detects the voltage drop under the heavy-load condition, the optimal drive condition is selected for heavy-load drive, thereby ensuring the maximum in added feature operation with respect to variations in voltage.

What is claimed is:

1. An electronic watch which uses a compact power supply as a drive source, and which is configured so as to drive a heavy load means such as a beeper device or illumination device, said electronic watch comprising:

a drive source;

a heavy load means;

means for driving said heavy-load means;

preparatory judging means for detecting an electrical energy level of said drive source at the current time and for judging whether or not said drive source is capable of driving said heavy-load means; and a heavy-load means drive control means for determining whether or not said heavy-load means driving means can be driven, in response to an output of said preparatory judging means.

2. An electronic watch according to claim 1, wherein said preparatory judging means comprises a means for comparing the electrical energy level of said drive source at the current time with a pre-established reference level.

3. An electronic watch according to claim 2, wherein said comparing means is configured so as to compare an electrical energy level held by said drive source with a plurality of reference levels and output different comparison judgment signals which correspond to said reference signals.

4. An electronic watch according to either claim 2 or claim 3, wherein said electrical energy level is selected a one of the drive source current and drive source voltage in the case in which said drive source is connected to an appropriate medium-load drive means.

5. An electronic watch according to claim 4, wherein said medium-load is a load that is smaller than the heavy load of an alarm or the like, but larger than the normal load for maintaining the operation of said electronic watch circuitry.

6. An electronic watch according to claim 5, wherein said medium-load driving means is formed by a resistor or a motor.

7. An electronic watch according to one of claim 1, wherein said power supply is an electricity-generating power supply.

8. An electronic watch according to claim 7, wherein said electrical energy level is a detected generated electricity amount value of said drive source.

9. An electronic watch according to any one of claim 2, wherein said heavy-load drive control means comprises a drive-signal generating means which outputs a plurality of heavy-load means drive signals having different drive capacities and a drive condition selection means which is configured so as to select one of said plurality of heavy-load means drive signals in response to a comparison signal which is output from said comparing means.

10. An electronic watch according to claim 9 further comprising a heavy-load voltage detecting means, and configured so that, even during drive by said heavy-load driving means, said heavy-load drive control means, in response to said detected voltage of said heavy-voltage means, selects an appropriate heavy-load drive signal from said plurality of types of heavy-load drive signals having different drive capacities and outputs said signal.

11. An electronic watch according to claim 9, wherein said plurality of types of heavy-load drive signals having different drive capacities comprise drive signals which have mutually differing duty cycle values.

12. An electronic watch according to any one of claim 1, wherein said drive source formed by said power supply is comprises a electrical charging device such as a solar battery and a storage device which is charged by said electrical charging device.

13. An electronic watch according to any one of claim 1, wherein said drive source formed by said power supply is comprises a secondary cell such as a lithium ion secondary cell.

14. An electronic watch according to claim 9, wherein said preparatory judging means executes said judgment in response to a heavy-load drive command signal which is output from said drive command means, and outputs the results thereof to said heavy-load means drive control means.

15. An electronic watch according to claim 9, wherein said drive-signal generating means generates a plurality of drive signals having different drive capacities.

16. An electronic watch according to claim 9, wherein said drive-signal generating means generates, in response to an output signal from said preparatory judging means, an appropriate timing signal.

17. An electronic watch according to claim 9, wherein said heavy-load drive control means further comprises a drive condition selection means which select one of a plurality of drive signals having different drive capacities that are generated by said drive-signal generating means.

* * * * *

UNITED STATES PATENT AND TRADEMARK OFFICE

CERTIFICATE OF CORRECTION

PATENT NO. : 5,886,953
DATED : March 23, 1999
INVENTOR(S) : H. Kawahara, et al.

It is certified that error appears in the above-identified patent and that said Letters Patent is hereby corrected as shown below:

Column 6,
Line 3: "batter" should read -- battery --

Column 10,
Line 10: 1 15 V" should reas -- 1.15 V --

Column 13,
Line 3: "0" should read -- Φ --
Line 56: "1 25 V" should read -- 1.25 V --

Column 15,
Line 34: "level" should read -- level "H"--

Column 19, claim 9,
Line 7: Delete -- anyone of --

Column 19, claim 12,
Line 27: Delete -- anyone of --

Column 20, claim 13,
Line 4: Delete -- anyone of --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,886,953
DATED : March 23, 1999
INVENTOR(S) : H. Kawahara, et al.

It is certified that error appears in the above-identified patent and that said Letters Patent is hereby corrected as shown below:

Column 6,
Line 3, "batter" should read -- battery --

Column 10,
Line 10, "1 15 V" should read -- 1.15 V --

Column 13,
Line 3, "0" should read -- Φ --
Line 56, " 1 25 V" should read -- 1.25 V --

Column 15,
Line 34, "level" should read -- level "H" --

Column 19, Claim 9,
Line 7, delete -- anyone of --

Column 19, Claim 12,
Line 27, delete -- anyone of --

Column 20, Claim 13,
Line 4, delete -- anyone of --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*